US011603672B2

(12) United States Patent
Apt

(10) Patent No.: US 11,603,672 B2
(45) Date of Patent: Mar. 14, 2023

(54) FLOOR TAPPING BLOCK

(71) Applicant: Michael Apt, Wellford, SC (US)

(72) Inventor: Michael Apt, Wellford, SC (US)

( * ) Notice: Subject to any disclaimer, the term of this patent is extended or adjusted under 35 U.S.C. 154(b) by 702 days.

(21) Appl. No.: 16/573,424

(22) Filed: Sep. 17, 2019

(65) Prior Publication Data

US 2020/0102759 A1 Apr. 2, 2020

Related U.S. Application Data

(60) Provisional application No. 62/738,258, filed on Sep. 28, 2018.

(51) Int. Cl.
*E04F 21/22* (2006.01)
*B25D 1/00* (2006.01)

(52) U.S. Cl.
CPC ..... *E04F 21/22* (2013.01); *B25D 1/00* (2013.01)

(58) Field of Classification Search
CPC ..... B25D 1/00; E04F 21/22
USPC ..... 81/46
See application file for complete search history.

(56) References Cited

U.S. PATENT DOCUMENTS

| | | | | |
|---|---|---|---|---|
| 5,701,680 | A * | 12/1997 | Garcia | E04F 21/20 33/526 |
| 5,845,548 | A | 12/1998 | Nelson | |
| 5,894,705 | A | 4/1999 | Sutton | |
| 5,984,271 | A | 11/1999 | Ellenberger | |
| 7,467,471 | B1 * | 12/2008 | Sutter | B43L 9/04 33/194 |
| 7,536,933 | B1 * | 5/2009 | Torres, Jr. | E04F 21/22 81/46 |
| 2005/0252167 | A1 | 11/2005 | Horne | |
| 2006/0278046 | A1 * | 12/2006 | Gargano | E04F 21/22 81/46 |
| 2008/0191180 | A1 * | 8/2008 | Gaunt | E04F 21/22 52/745.19 |
| 2013/0008290 | A1 | 1/2013 | Bugallo et al. | |
| 2020/0078924 | A1 * | 3/2020 | Cavaliere | B25G 1/04 |

* cited by examiner

*Primary Examiner* — Hadi Shakeri
(74) *Attorney, Agent, or Firm* — Boudwin Intellectual Property; Daniel Boudwin

(57) ABSTRACT

A floor tapping block is described. The floor tapping block includes a planar base having a front downward facing tongue extending below the planar base. The planar base has a track attached to a top surface thereof. A handle portion having a groove can be fitted over the track on the planar base. The handle portion having a front face configured to be hit with a hammer. This portion can be a flat portion raised from the handle. A locking pin to secure the handle portion to the planar base. The locking pin may be a spring biased pin that locks into predefined locking holes in the planar base. The locking pin may also be a combination of a screw and a nut.

13 Claims, 7 Drawing Sheets

FLOOR TAPPING BLOCK

CROSS REFERENCE TO RELATED APPLICATIONS

This application claims the benefit of U.S. Provisional Application No. 62/738,258 filed on Sep. 28, 2018. The above identified patent application is herein incorporated by reference in its entirety to provide continuity of disclosure.

BACKGROUND OF THE INVENTION

The present invention relates to a floor tapping block. More particularly, the present invention provides and adjustable floor tapping block.

When putting in floors of all kinds it is necessary to place the floor then move it into the proper place. When placing some hardwood and other floors, the slats need to be pressed together to form the correct seal. In many flooring models, there are tongue and groove attachments than need to be placed together. These attachments can require the floor panels to be pushed downward in order to align and fit together. Traditional methods do not have the ability to allow for pressure to be pressed downwards. Further, traditional methods do not always fit into tight spaces next to walls and cabinets.

Consequently, there is a need in for an improvement in the art of installing floors. The present invention substantially diverges in design elements from the known art while at the same time solves a problem many people face when installing floors. In this regard the present invention substantially fulfills these needs.

SUMMARY OF THE INVENTION

The present invention provides a floor tapping block wherein the same can be utilized for providing convenience for the user when installing floors. The present system comprises a planar base having a front downward facing tongue extending below the planar base. The planar base may have a track attached to a top surface thereof. A handle portion having a groove can be fitted over the track on the planar base. The handle portion having a front face configured to be hit with a hammer. This portion can be a flat portion raised from the handle. A locking pin to secure the handle portion to the planar base. The locking pin may be a spring biased pin that locks into predefined locking holes in the planar base. The locking pin may also be a combination of a screw and a nut.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
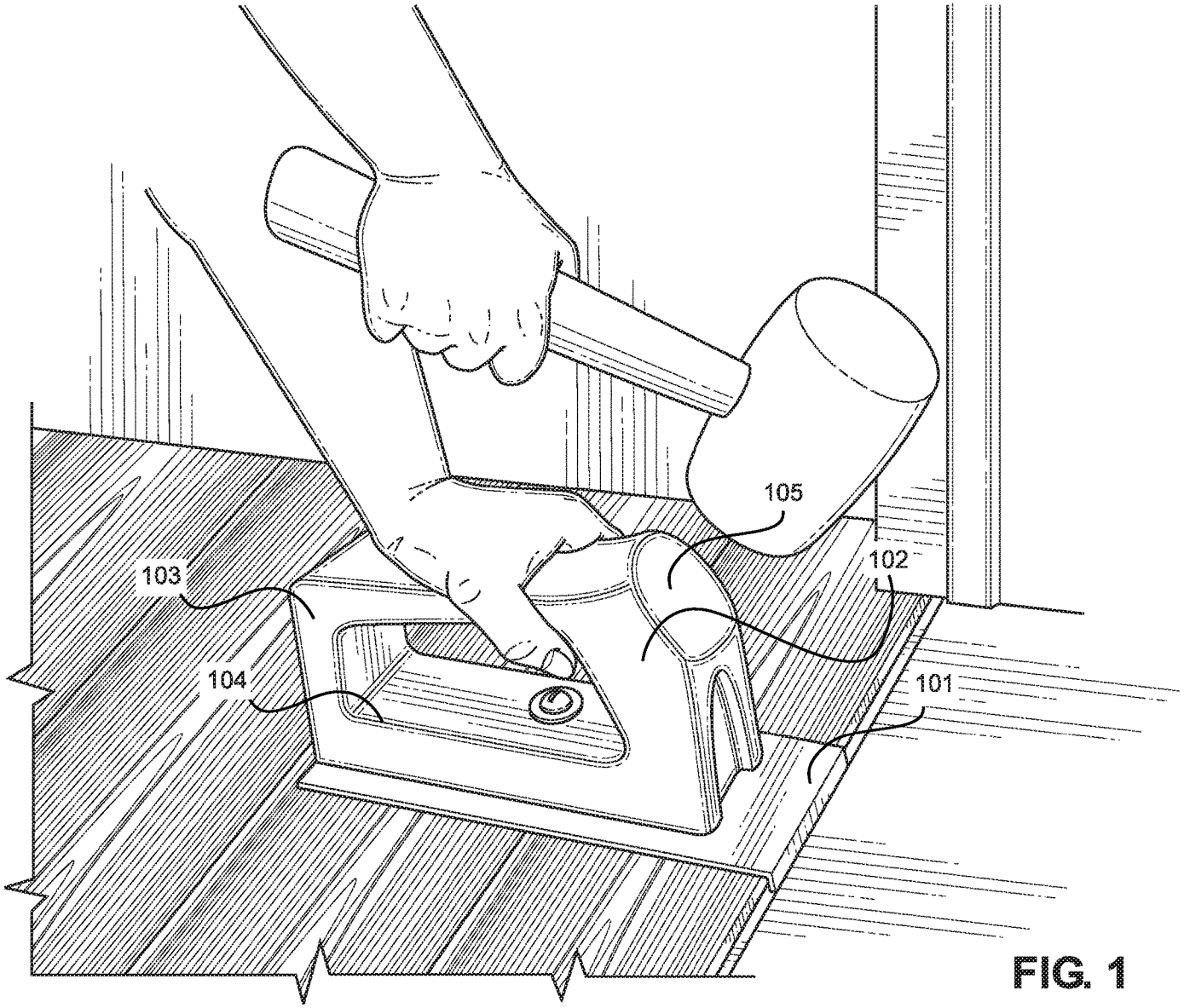
FIG. 1 shows a perspective view of an embodiment of the floor tapping block in use.

Reference is made herein to the attached drawings. Like reference numerals are used throughout the drawings to depict like or similar elements of the floor tapping block. For the purposes of presenting a brief and clear description of the present invention, a preferred embodiment will be discussed as used for the floor tapping block. The figures are intended for representative purposes only and should not be considered to be limiting in any respect.

Referring now to FIG. 1, there is shown a perspective view of an embodiment of the floor tapping block in use. The floor tapping block has a planar base 101 and a handle portion 102. In the shown embodiment the handle portion 102 has a has a top section 103 and a bottom section 104 with a hollow space located therebetween. In other embodiments there is no hollow space between the top section 103 and the bottom section 104. In one embodiment the top section 103 is rounded in order to make for a more comfortable gripping portion.

The handle portion 102 further has a front face 105 connected to the bottom section 104 and the top section 103. In one embodiment the front face 105 has a flat section located thereon. The front face is configured to be struck by a hammer or mallet. In one embodiment the flat section is angled. The angle will be an obtuse angle in relation to the front plane of the front face. This will allow for a force to be exerted vertically and horizontally when the front face is struck. In another embodiment the front face 105 may be a raised section on the handle portion 102. In this embodiment the raised section will extend out and up about the plane of the top section 103.

Figure 2A:
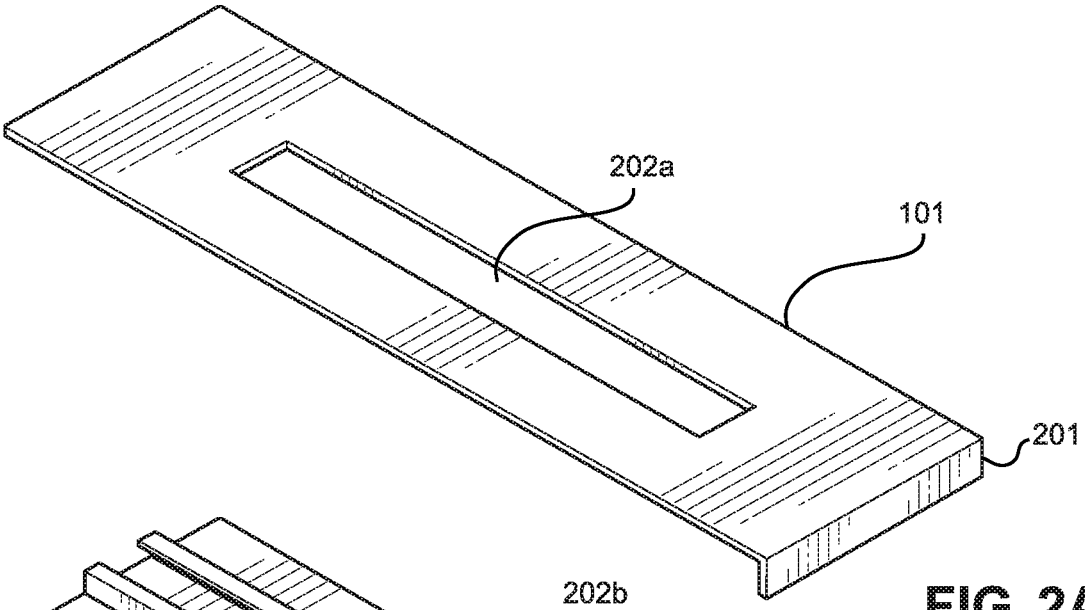
FIG. 2A shows a side perspective view of an embodiment of the planar base of the floor tapping block.
Figure 2B:
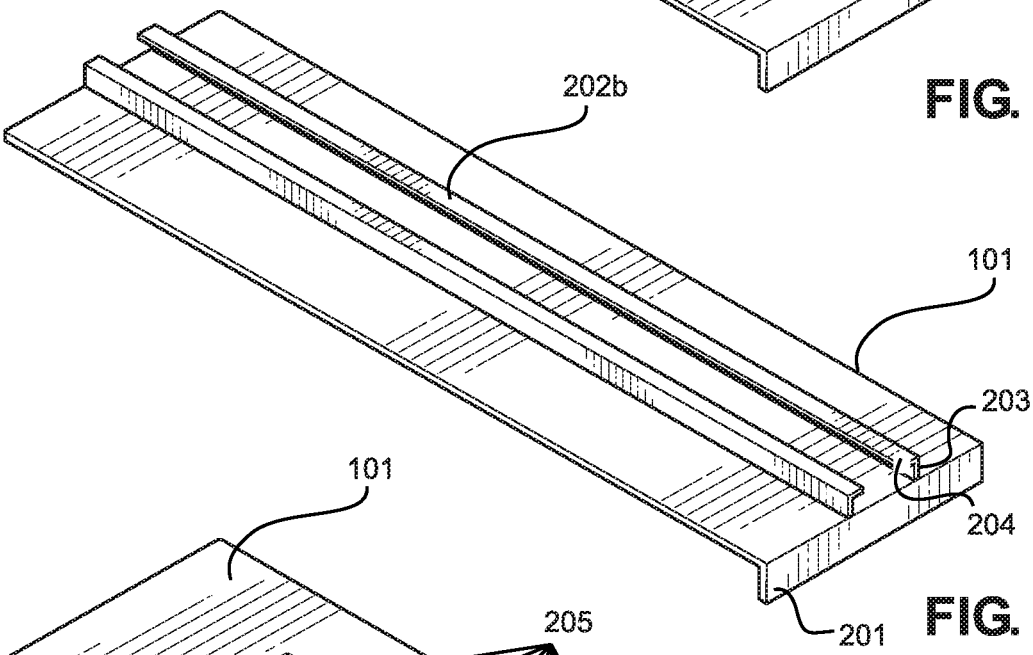
FIG. 2B shows a side perspective view of an alternate embodiment of the planar base of the floor tapping block.
Figure 2C:
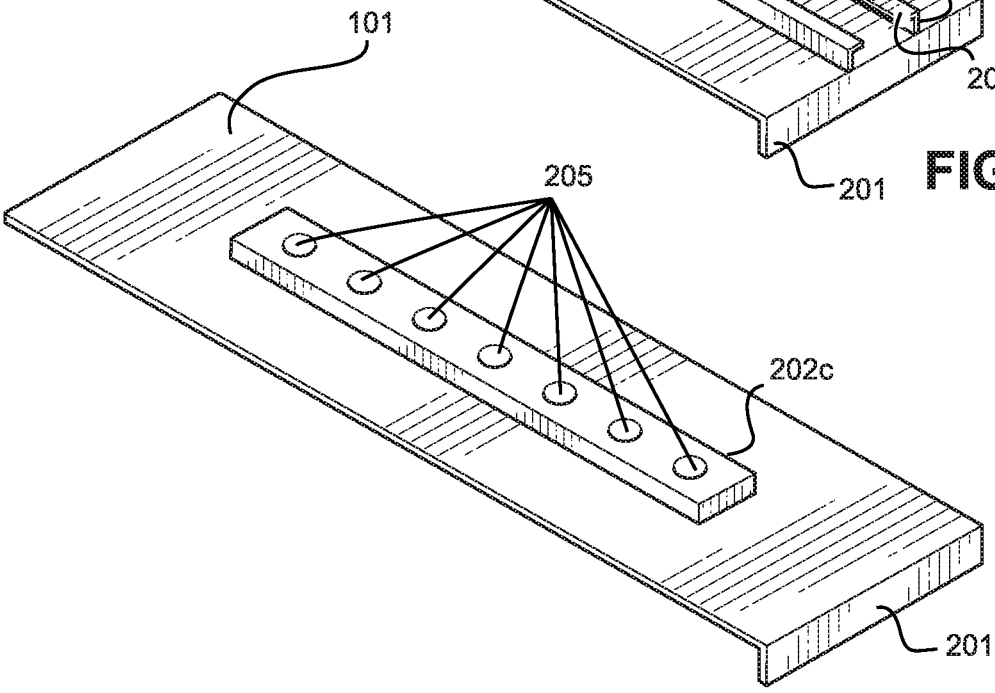
FIG. 2C shows a side perspective view of an embodiment of the planar base of the floor tapping block with predefined holes for the locking pin.

Referring now to FIG. 2A, FIG. 2B, and FIG. 2C, there are shown several embodiments of the planar base of the floor tapping block. The planar base 101 is a rectangular shape having two longer sides and two shorter sides. The planar base 101 has a tongue 201 the protrudes from one of the shorter sides of the planar base 101. The tongue 201 protrudes perpendicular to the planar base 101. This will allow the tongue 201 to be placed on top of and next to a piece of flooring at the same time. The tongue 201 is configured to contact a piece of flooring and move the flooring when the floor tapping block is in use.

In one embodiment as shown in FIG. 2A the planar base 101 has an aperture channel 202*a* located on a top surface. The channel 202*a* is configured to receive a portion of the bottom section of the handle. In one embodiment the portion of the bottom section will frictionally fit within the channel 202*a* attaching the planar base 101 to the handle.

Figure 4:
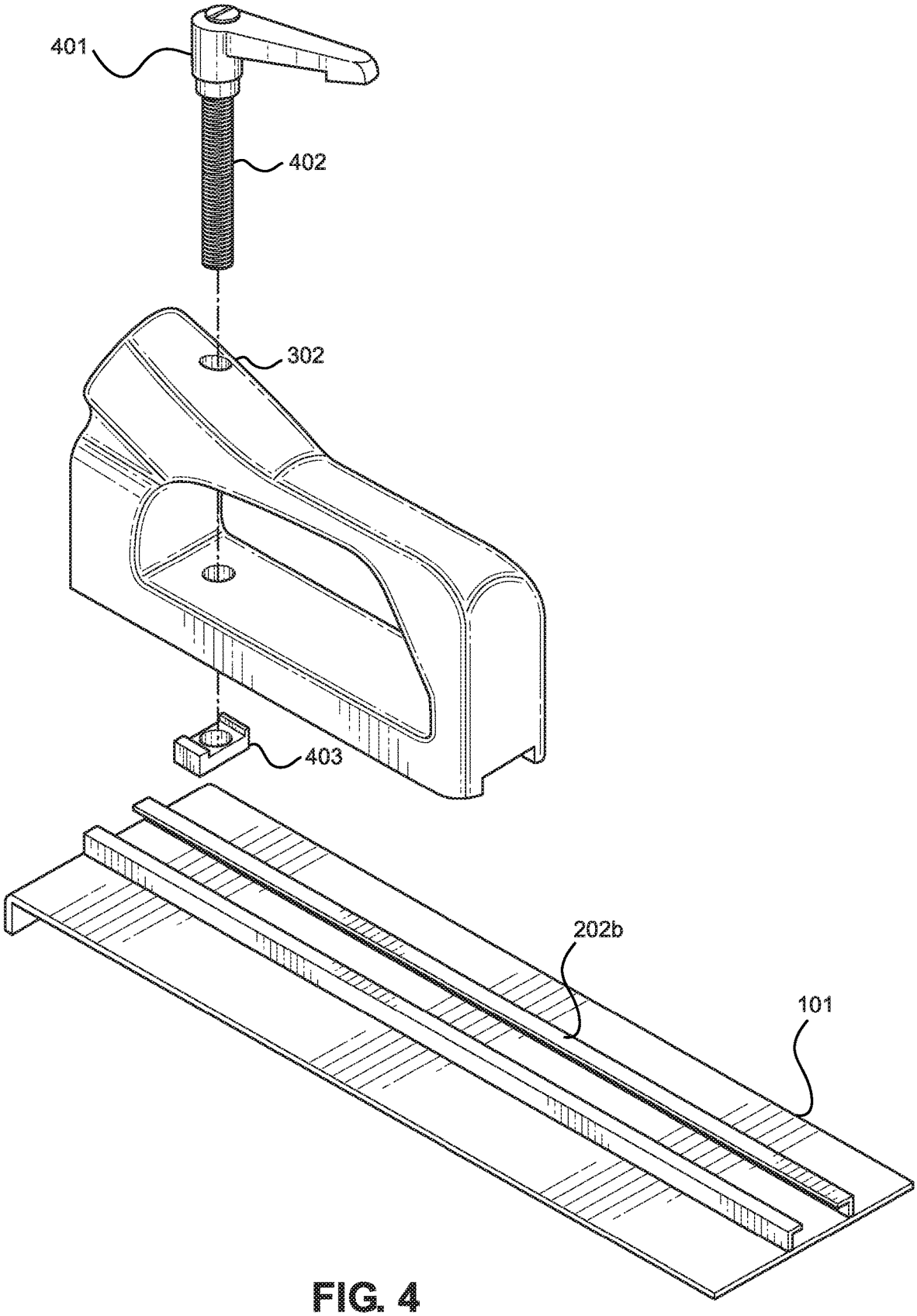
FIG. 4 shows an exploded view of an embodiment of the floor tapping block with a screw and nut locking pin.

In another embodiment, as shown in FIG. 2B, there is a raised channel 202*b* located on a top side of the planar base 101. The channel 202*b* has a pair of sidewalls 203 that extend upwardly from the planar base 101. A top section of the sidewalls 203 has a lip 204 attached thereto, such that a gap is formed between each lip 204. In this embodiment, the channel 202*b* is configured to accept a nut therein as shown in FIG. 4.

In yet another embodiment, as shown in FIG. 2C, there is a raised portion 202*c* extending upwardly from the planar base 101. In this embodiment, the raised portion 202*c* has a plurality of apertures 205 located therein. The apertures 205 are configured to accept a locking pin therein as shown in FIG. 3.

Figure 5:
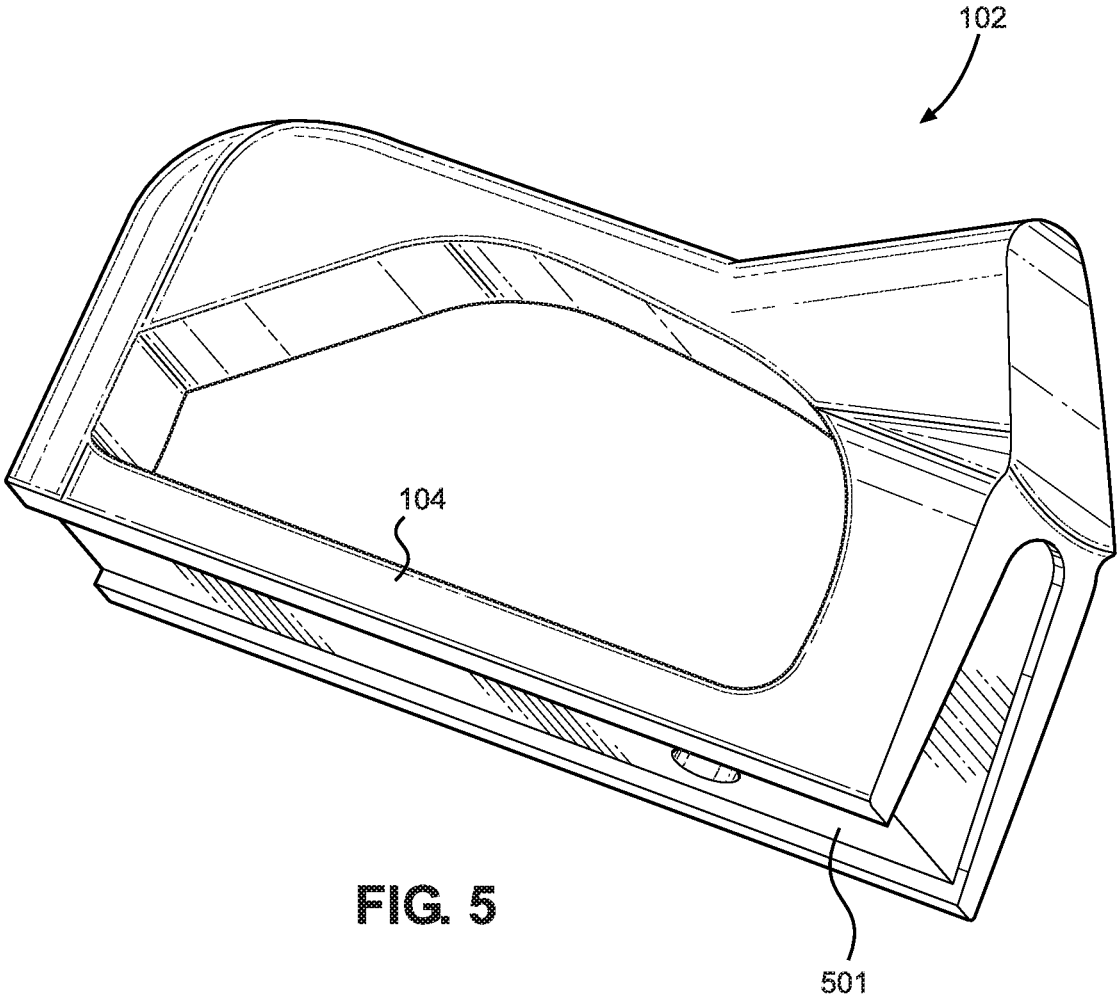
FIG. 5 shows a perspective view of the handle wherein the bottom portion can be seen with a groove therein.

Referring to FIG. 5 there is shown a perspective view of the handle wherein the bottom portion can be seen with a groove therein. In one embodiment there is a groove 501 located in the bottom section 104 of the handle 102. The groove 501 is recessed into the bottom section 104. In the shown embodiment the groove 501 goes from the back of the bottom portion all the way through the front face. In other embodiments the groove 501 can have varying configurations, so long as the handle can slide along the channel or raise portion and the position adjusted relative to the planar base. The groove 501 is a rectangular groove and is configured to accept the raised portion or the channel as described in FIG. 2B and FIG. 2C. The groove 501 will allow the handle 102 to be slide along the planar base while staying in the given alignment. Further, without the groove 501 the handle could spin when struck in use.

Figure 3:
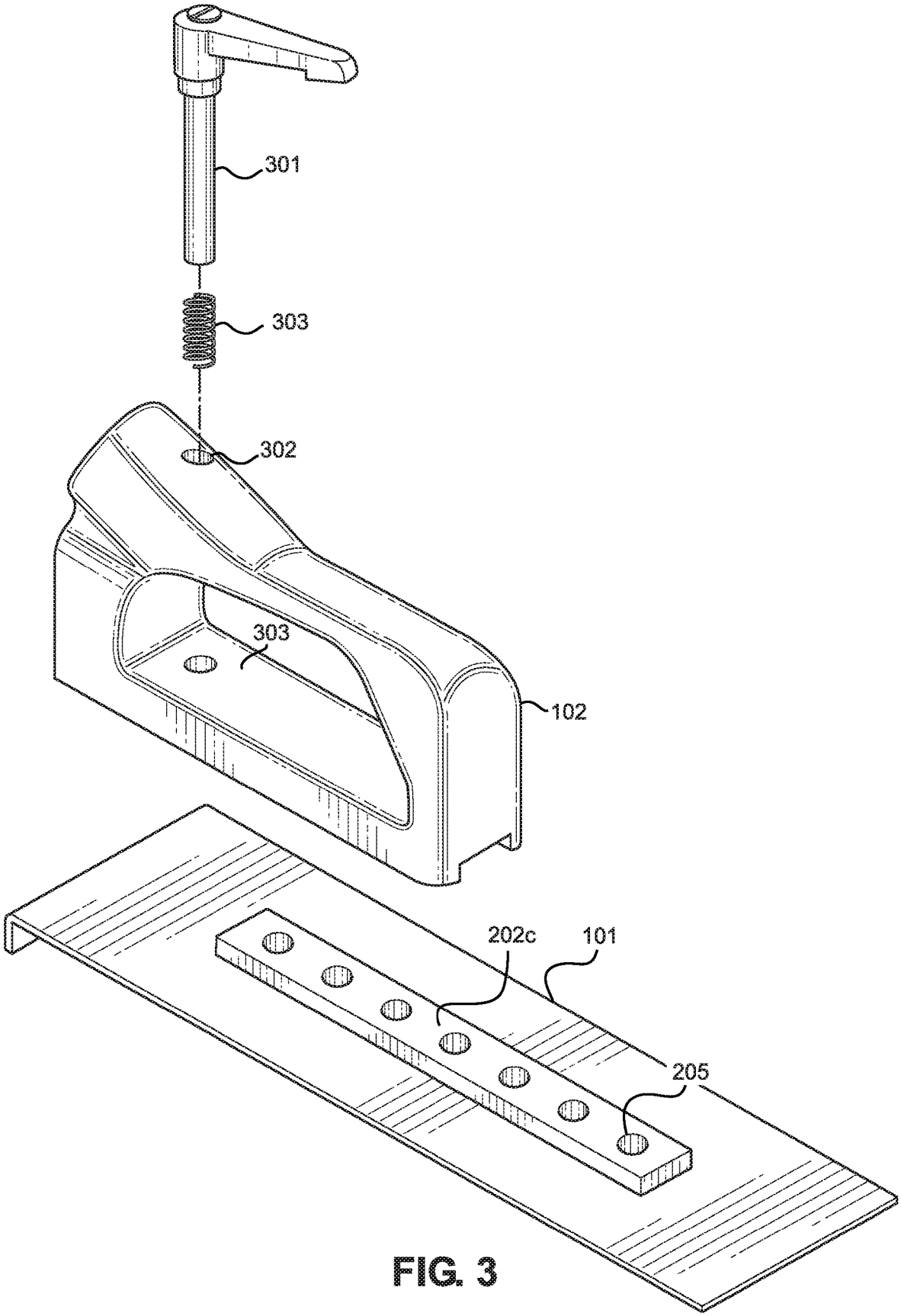
FIG. 3 shows an exploded view of an embodiment of the floor tapping block with a spring biased locking pin.

Referring now to FIG. 3, there is shown an exploded view of an embodiment of the floor tapping block with a spring biased locking pin. In one embodiment, there is a spring biased locking pin 301. The spring biased locking pin 301 is configured to be placed in a hole 302 or a plurality of holes 302 located through the handle portion 102. The spring biased locking pin has a spring 303 that is placed around the spring biased locking pin 301. The spring 303 and spring biased locking pin 301 are movably coupled to the handle portion 102 such that the spring biased locking pin 301 can be pulled in an upward motion. The spring biased locking pin 301 is configured to lock into the holes 205 located in the raised portion 202*c* of the planar base 101. In this manner, the handle portion 102 will be locked in a set position on the planar base 101.

Referring now to FIG. 4, there is shown an exploded view of an embodiment of the floor tapping block with a screw and nut locking pin. In the illustrated embodiment, there is a screw locking pin 401. The screw locking pin 401 is configured to be placed in a hole 302 or a plurality of holes 302 located through the handle portion 102. The screw locking pin 401 has a threaded lower portion 402 and a handle portion 404. The handle portion is configured such that it can be grasped by a user and rotated to rotate the screw locking pin. This will tighten or loosen the locking pin.

There is further a nut 403 that is configured to be placed in the channel 202 of the planar base 101. The handle portion 102 is configured to accept the channel 202*b* of the planar base 101 such that it can slide along the planar base 101. The screw locking pin 401 is configured to be screwed into the nut 403 located in the channel 202*b* of the planar base 101. The screw locking pin 401 can be screwed into the nut 403 in this manner the handle portion 102 will be locked in a set position on the planar base 102.

The floor tapping device is used in the following manner. The planar base is placed on the floor such that the tongue is located on the edge of a floor section. The handle portion is then placed on the planar base such that the channel aligns with the groove on the handle portion. The handle portion is set to a distance on the planar base. The handle is then hit with a hammer or mallet moving the floor section into the correct place.

Figure 6:
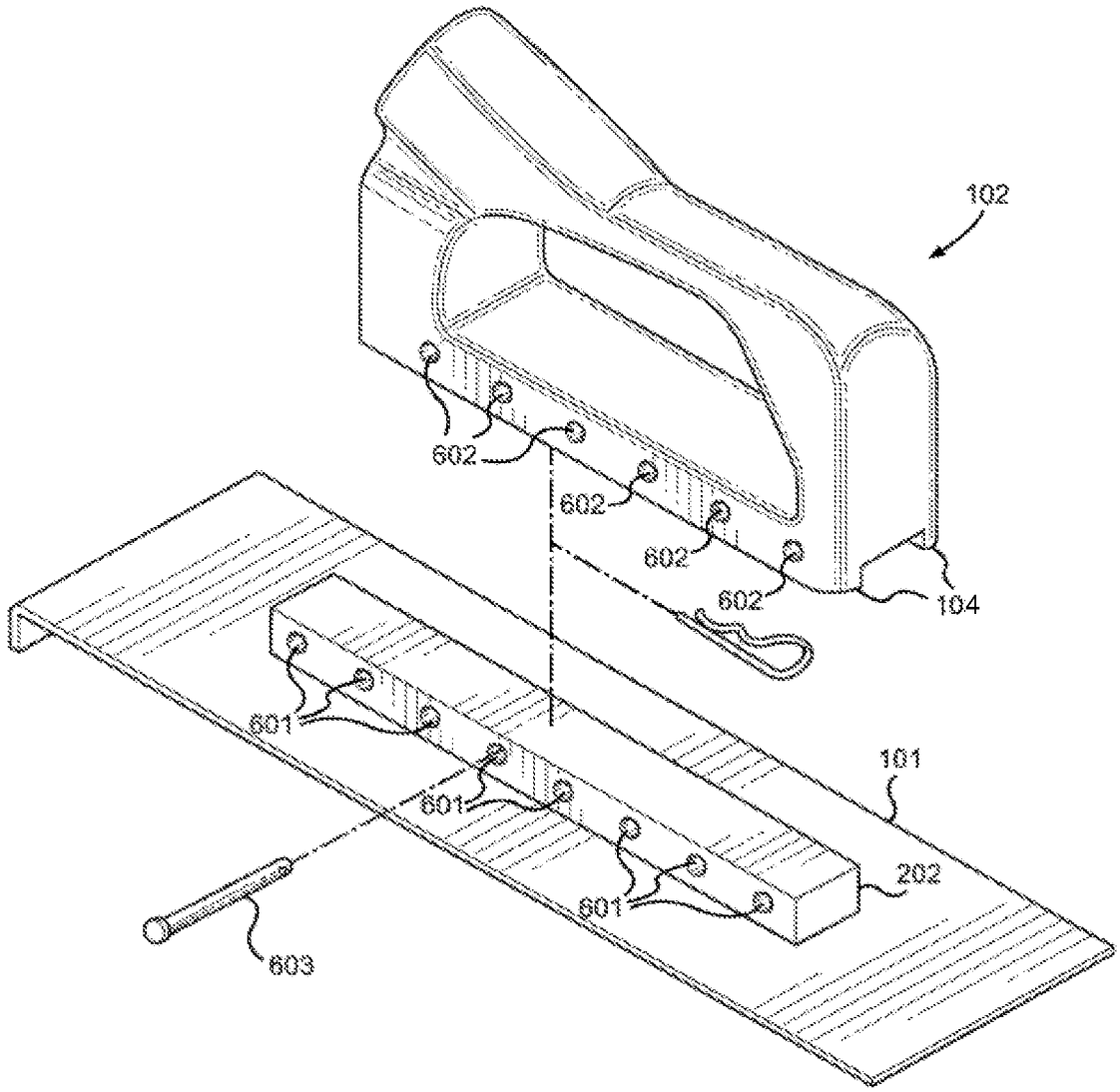
FIG. 6 shows an exploded view of an embodiment of the floor tapping block with a different connection to the base.

Referring now to FIG. 6, there is shown an exploded view of an embodiment of the floor tapping block with a different connection to the base. In this embodiment the handle portion will have a plurality of apertures 602 located in the bottom section 103. The apertures 602 will pass through the entire bottom section 103. In this embodiment the planar base 101 has a raise portion 202. The raise portion 202 has a plurality of horizontal apertures 601. The horizontal apertures 601 are configured to align with the apertures 602 in the bottom section 103. In this embodiment a pin 603 is included to attach the handle portion 102 to the planar base 101. The pin 603 has a pin head that will prevent the pin from going clear through the bottom portion 103. In on embodiment the pin is held in place with a cotter pin that is configured to attach to the pin.

Figure 7:
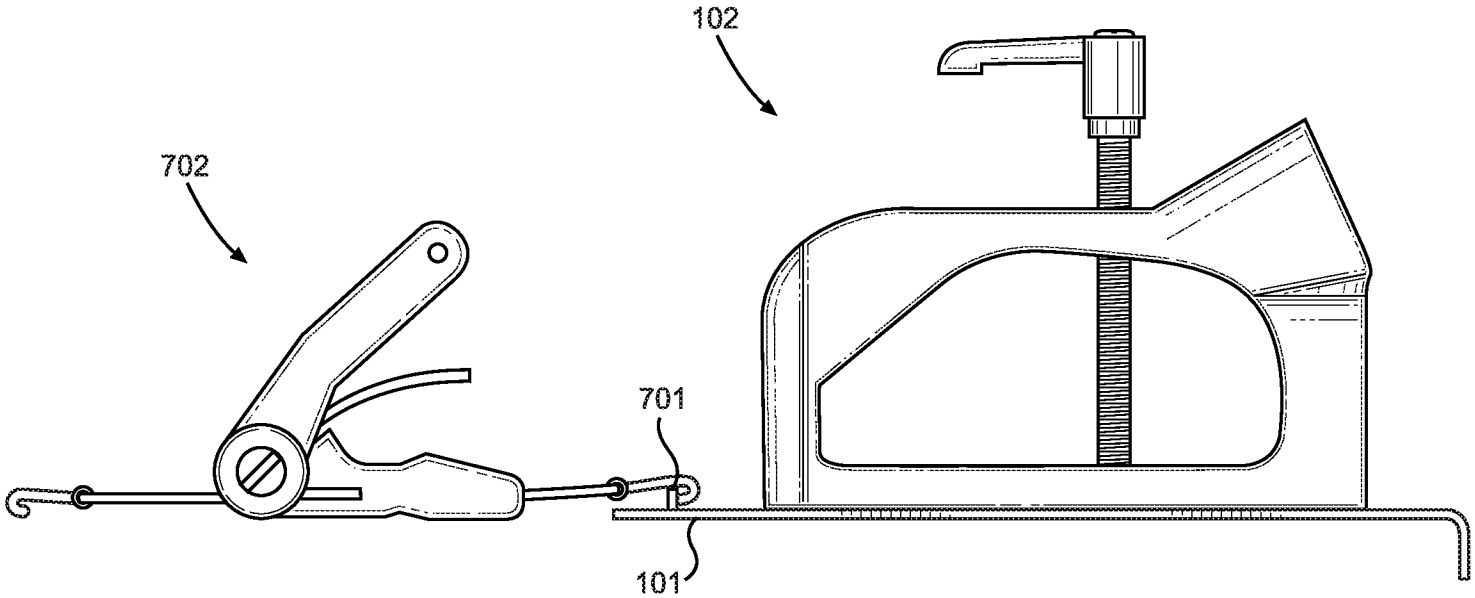
FIG. 7 shows a perspective view of an embodiment of the floor tapping block with a ratchet attached.

Referring now to FIG. 7, there is shown a perspective view of an embodiment of the floor tapping block with a ratchet attached. In one embodiment there is a ratchet attachment 701 located on the planar base 101. The ratchet attachment 701 rises from the planar base in the same side as the handle portion 102. The ratchet attachment 701 is configured to allow a ratchet strap 702 to be coupled to the planar base 101. This will allow a user to ratchet the floor tapping block and pull the flooring into the right place instead of hitting the block with a mallet.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A floor tapping block, comprising:

a planar base includes a pair of parallel sides, a bottom face, and a top face;

a first pair of parallel sides is longer than a second pair of parallel sides;

the planar base having a tongue protruding from one side of the planar base and extending perpendicularly from the planar base;

an aperture channel extending through of the planar base;

a handle portion having a top section and a bottom section;

whereby the handle portion includes an extended portion on a bottom face formed by a groove recessed on the bottom section and a front face disposed on the top section;

wherein the front face is angularly raised from the top section of the handle portion;

wherein the extended portion is configured to be placed within the aperture channel;

the front face is configured to be hit with a hammer; and wherein the extended portion is secured in the aperture channel via a friction fit.

2. The floor tapping block of claim 1, wherein the handle portion is made from wood.

3. The floor tapping block of claim 1, wherein the planar base comprises a rachet attachment extending upwardly therefrom to accept a ratchet strap.

4. A floor tapping block, comprising:

a planar base includes a pair of parallel sides, a bottom face, and a top face;

a first pair of parallel sides is longer than a second pair of parallel sides;

the planar base having a tongue protruding from one side of the planar base and extending perpendicularly from the planar base;

a pair of parallel sidewalls extend upwardly from the planar base defining a raised channel on the top side of the planar base;

a top section each parallel sidewall of the pair of parallel sidewalls has a lip and forming a gap;

the raised channel is configured to accept a nut therein;

a handle portion having a top section, a bottom section, and a groove;

the groove located within a bottom face of the bottom section, wherein the groove is configured to accept the raised channel;

whereby the handle portion includes an extended portion on a bottom face and a front face disposed on the top section;

wherein the front face is angularly raised from the top section of the handle portion;

the front face is configured to be hit with a hammer;

a locking device to secure the handle portion to the planar base via the nut; and a plurality of holes located through the handle portion to accept the locking device therethrough.

5. The floor tapping block of claim 4, wherein the locking device comprises a screw locking pin.

6. The floor tapping block of claim 4, wherein the locking device is configured to be connected to the nut.

7. The floor tapping block of claim 4, wherein the planar base further comprises a rachet attachment extending upwardly therefrom to accept a ratchet strap.

8. A floor tapping block, comprising:

a planar base includes a pair of parallel sides, a bottom face, and a top face;

a first pair of parallel sides is longer than a second pair of parallel sides;

the planar base having a tongue protruding from one side of the planar base and extending perpendicularly from the planar base;

a raised portion on the top face of the planar base;

the raised portion comprises a top side, a front side, a rear side, and a pair of side faces;

a handle portion having a top section, a bottom section, and a groove;

the groove located within a bottom face of the bottom section, wherein the groove is configured to accept the raised portion;

whereby the handle portion includes an extended portion on a bottom face thereof and a front face disposed on the top section;

wherein the front face is angularly raised from the top section of the handle portion;

the front face is configured to be hit with a hammer;

a locking device to secure the handle portion to the planar base; and a plurality of holes located through the bottom section of the handle portion align with a plurality of apertures disposed on the raised portion; and the locking device secures in the handle portion to the planar base by threading the plurality of holes on the handle portion and the plurality of apertures on the raised portion of the planar base.

9. The floor tapping block of claim 8, wherein the plurality of apertures are configured to accept the locking device.

10. The floor tapping block of claim 8, wherein the locking device further includes a locking pin; whereby the locking pin is a spring biased pin that locks into predefined locking holes in the planar base.

11. The floor tapping block of claim 10, wherein the locking pin is a screw.

12. The floor tapping block of claim 8, wherein the planar base further comprises a rachet attachment extending upwardly therefrom to accept a ratchet strap.

13. The floor tapping block of claim 8, wherein plurality of apertures is disposed on the pair of side faces of the raised portion.

* * * * *